US007963129B2

(12) United States Patent
Kwon

(10) Patent No.: US 7,963,129 B2
(45) Date of Patent: Jun. 21, 2011

(54) DRUM TYPE LAUNDRY MACHINE

(75) Inventor: Dae Hee Kwon, Busan (KR)

(73) Assignee: LG Electronics Inc., Seoul (KR)

( * ) Notice: Subject to any disclaimer, the term of this patent is extended or adjusted under 35 U.S.C. 154(b) by 1001 days.

(21) Appl. No.: 11/585,331

(22) Filed: Oct. 24, 2006

(65) Prior Publication Data

US 2007/0137261 A1 Jun. 21, 2007

(30) Foreign Application Priority Data

Oct. 25, 2005 (KR) ..... 10-2005-0100688

(51) Int. Cl.
*D06F 39/00* (2006.01)

(52) U.S. Cl. ..... 68/12.26; 8/158; 68/12.01; 68/142

(58) Field of Classification Search ..... 8/158; 68/12.01, 68/12.26, 142
See application file for complete search history.

(56) References Cited

U.S. PATENT DOCUMENTS 6,766,596 B1 * 7/2004 Bienick et al. ..... 34/601
2003/0172689 A1 * 9/2003 Fitton et al. ..... 68/12.26
2004/0107742 A1 * 6/2004 Kim et al. ..... 68/24

* cited by examiner

*Primary Examiner* — Michael Barr
*Assistant Examiner* — Jason Heckert
(74) *Attorney, Agent, or Firm* — KED & Associates LLP

(57) ABSTRACT

A drum type laundry machine is disclosed. A drum type laundry machine comprises a cabinet cover for defining a front surface of a body, the cabinet cover having an opening for loading/unloading the laundry therein/there from, a recess part recessed toward an inside of the body along a circumference of the opening, a door assembly having some portion inserted in the recess part when being closed together with the opening, a protrusion projected from an inner surface of the recess part to reinforce strength of the recess part and to support the door assembly securely. An object of the present invention is to provide a drum type laundry machine which can precisely communicate a hook assembly of a door assembly with a locking assembly. Another object of the present invention is to provide a drum type laundry machine which can prevent the damage of the door assembly due to deformation between the door assembly and a body, external impact might cause.

15 Claims, 10 Drawing Sheets

DRUM TYPE LAUNDRY MACHINE

This application claims the benefit of the Patent Korean Application No. 10-2005-0100688, filed on Oct. 25, 2005, which is hereby incorporated by reference as if fully set forth herein.

BACKGROUND OF THE INVENTION

1. Field of the Invention

The present invention relates to a drum type laundry machine, more particularly, to a drum type laundry machine which can communicate a hook assembly of a door assembly with a locking assembly of a body precisely to prevent damage of a door assembly, which might be caused by deformation there between.

2. Discussion of the Related Art

In general, a laundry machine including a washer and a dryer washes or dries clothes, cloth items, beddings and the like (hereinafter, the laundry).

Especially, a drum type laundry machine has a drum horizontally mounted to load/unload the laundry there in/from.

FIGS. 1 to 3 illustrate a conventional drum type laundry machine according to the prior art.

A conventional drum type laundry machine includes a body 10 for defining an exterior thereof, a tub 20 mounted within the body 10 and a drum 30 rotatably mounted within the tub 20.

An opening 11 is formed in front of the body 10 in communication with the inside of drum 30.

Also, a door assembly 40 is coupled to a front surface of the body 10 to selectively open/close the opening 11.

Here, a recess part 12 is recessed inwardly in a portion of the body's front surface. Some portion of the door assembly 40 is inserted in the recess part 12 to prevent exterior beauty of the door assembly 40 from deteriorating, which might be caused due to too much exposure of the door assembly 40.

The door assembly 40 is rotatably mounted on a surface within the recess part 12 of the body's front surface by a door hinge 51.

Together with that, a hook assembly 52 is provided on a portion of the door assembly 40, which is opposite to a portion where the door hinge 51 is formed. The hook assembly 52 is selectively inserted in a locking hole 13 formed on the recess part 12.

Here, a locking assembly 53 is provided on an inner wall of the body 10, which is an inside of the locking hole 13, to selectively lock the hook assembly 52. Owing to communication with the hook assembly 42, the locking assembly 42 checks whether the door assembly 40 is closed and supplies a corresponding signal to a controller (not shown).

However, in the conventional structure of fastening the door assembly 40 to the body 10, the distance between the door assembly 40 and the recess part 12 is long. Thereby, if the door assembly 40 gets a strong impact, for example an impact received by dropping it in transportation, an edge or a circumference thereof can cut the inner surface of the recess part 12 enough to cause damage of the edge or the circumference of the door assembly 40 as well as damage of the recess part 12.

Furthermore, since the recess part 12 of the conventional laundry machine has a large plane portion, there is a problem that strength of the recess part 12 cannot but deteriorate or the plane portion might be curved, compared with the other portions. Accordingly, there is another problem that the portion of the recess part 12, where the door hinge 51 is fastened, may be deformed.

In case of that deformation, the door assembly 40 can be deformedly inserted in the position beyond the locking member 53 *a* of the locking assembly 52. Thereby, even when the door assembly 40 is opened, the locking assembly 40 may fail to recognize that.

SUMMARY OF THE INVENTION

Accordingly, the present invention is directed to a drum type laundry machine.

An object of the present invention is to provide a drum type laundry machine which can precisely communicate a hook assembly of a door assembly with a locking assembly.

Another object of the present invention is to provide a drum type laundry machine which can prevent the damage of the door assembly due to deformation between the door assembly and a body, external impact might cause.

Additional advantages, objects, and features of the invention will be set forth in part in the description which follows and in part will become apparent to those having ordinary skill in the art upon examination of the following or may be learned from practice of the invention.

The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drum type laundry machine comprises a cabinet cover for defining a front surface of a body, the cabinet cover having an opening for loading/unloading the laundry therein/there from; a recess part recessed toward an inside of the body along a circumference of the opening; a door assembly having some portion inserted in the recess part when being closed together with the opening; and a protrusion projected from an inner surface of the recess part to reinforce strength of the recess part and to support the door assembly securely.

Preferably, the protrusion may be formed on a position in a predetermined width not interfering with the door assembly. In that case, the distance between the door assembly and the recess part may be minimized and the maximum opening angle of the door assembly may be supplied.

Preferably, the protrusion may be a step part projected from an inner surface of the recess part, stepped toward an opposite direction of the closed door assembly.

In that case, the distance between the door assembly and the recess part is reduced. Thus, if external impact is applied to the door assembly, damage of the recess part or the door assembly is prevented in advance, which might be caused when the edge or circumferential surface of the door assembly cuts the inner surface of the recess part. Also, since the step part may reinforce the recess part, the deformation of the recess part or the recess part's being curved will be prevented, too.

The step part may be formed along an inner circumference of the recess part and the step part may have at least one step. In that case, there may be a strong reinforcing effect and the door assembly can be supported more securely if the external impact is applied.

Preferably, a facing part is provided in the step part to face some portion of the door assembly's rear surface when the door assembly is closed. The facing part supports the door assembly more securely when the door assembly is closed or external impact is applied to the door assembly to prevent the deformation of the cabinet cover or the recess part's being curved.

The facing part may have a predetermined width and another predetermined width different from the predetermined width. In that case, the door assembly is prevented from going beyond the recess part.

Preferably, a door hinge is fastened to a side of the recess part and a locking assembly is provided in the other side of the recess part. in case the door hinge and the locking assembly is provided in the recess part having the protrusion, the damage of the locking assembly or the damage of the portion, where the door hinge and the locking assembly are provided, can be prevented.

The door hinge may be fastened to a side of a door, and the locking assembly may be selectively locked to a hook assembly provided in the other side of the door. In that case, the width of the facing part facing the door hinge is different from the width of the facing part facing the hook assembly.

Preferably, the width of the facing part facing the door hinge is getting larger and larger as getting to the facing part facing the hook assembly. Also, the width of the facing part facing the hook assembly is twice as large as the width of the facing part facing the door hinge. Since the door assembly of the facing part facing the door hinge is inserted in the recess part by the door hinge in that case, the load of the external impact which might be applied, can be dispersed to the facing part facing the door hinge and the door hinge.

Also, since the width of the facing part facing the hook assembly is larger than the width of the facing part facing the door hinge, the facing part facing the hook assembly can support the door assembly securely if the door assembly is opened/closed or external impact is applied to the door assembly. Accordingly, the door assembly is prevented from going beyond the step part to collide with the recess part.

The facing part facing the door hinge is formed in a predetermined width not interfering with the door assembly when the door assembly is opened/closed. In case that, the opening angle of the door assembly may be maximized.

The drum type laundry machine according to the present invention has following advantageous effect.

First, the communication between the hook assembly of the door assembly and the locking assembly of the body can be precise, because the door assembly is supported securely by reinforcing the strength of the recess part due to the protrusion formed on the cabinet cover.

Secondly, the drum type laundry machine may check whether the door assembly is opened or closed.

Thirdly, the door assembly may not go beyond the body even when external impact is applied to the door assembly during the transportation.

Finally, the user's inconvenience may be removed, because the distance between the door assembly and the recess part is minimized and the door assembly may be opened at the maximum angel of more than 160° at the same time.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Referring to FIGS. 4 to 10, a preferred embodiment of the present invention will be described.

A drum type laundry machine according to the present invention comprises a cabinet cover 610, a recess part 620, a door assembly 400 and a step part 630.

Figure 4:
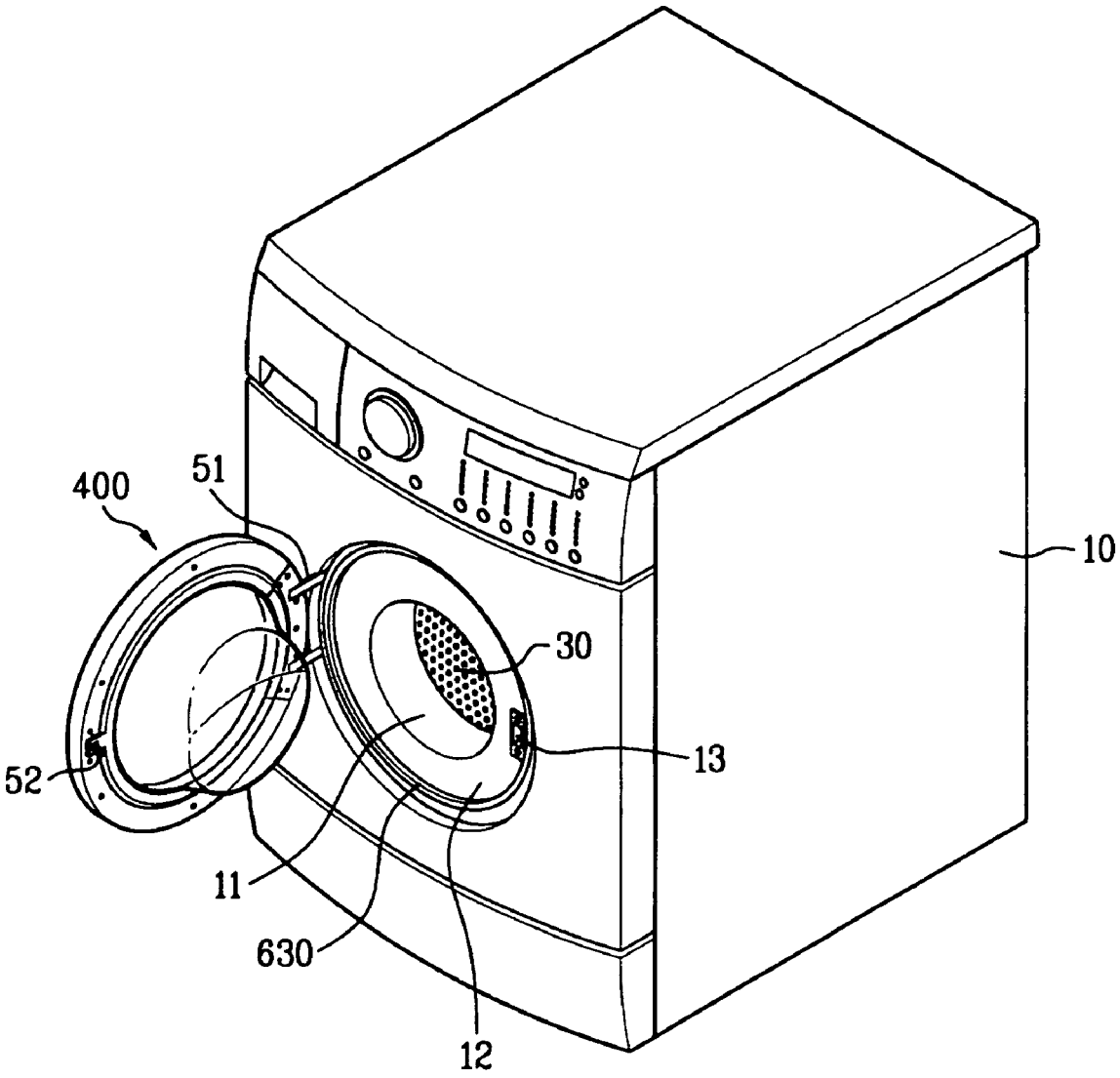
FIG. 4 is a perspective view illustrating an exterior of a drum type laundry machine according to a preferred embodiment of the present invention.

Referring to FIG. 4, the cabinet cover 610 will be described.

The cabinet cover 610 forms a front surface of a body 10 defining an exterior of the drum type laundry machine.

Here, an opening 611 is formed on the cabinet cover to load/unload the laundry there in/from. The opening 611 is in communication with an inside of a drum 30 provided within the body 10.

Next, referring to FIG. 5, the recess part 620 will be described.

The recess part 620 is recessed toward the inside of the body along a circumference of the opening 611 provided on the cabinet cover 610.

The recess part 620 minimizes the door assembly 400 from being exposed an outside of the body's front surface.

At that time, the opening 611 is formed in a center of the recess part 620.

An end of a door hinge 510, which will be described later, is inserted in a portion of the recess part 620 and a locking assembly, which will be described later, is recessed in the other portion of the recess part 620.

Next, referring to FIG. 5, a door assembly 400 will be described.

The door assembly 400 is inserted in the recess part 620 to selectively open/close the opening 611.

The door assembly 400 comprises a frame part (not shown), a door handle (not shown) and a door glass 430.

Figure 5:
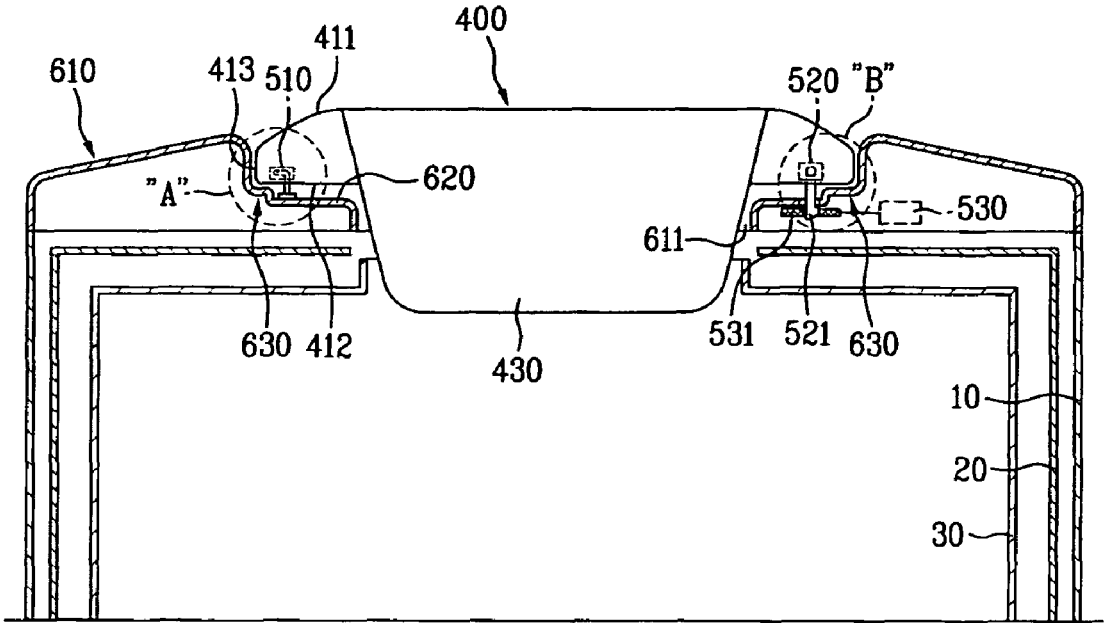
FIG. 5 is a sectional view schematically illustrating the fastening structure between a door assembly and a body of the drum type laundry machine according to the embodiment of the present invention.

As shown in FIG. 5, the frame part is a portion where a couple of frames 411 and 412 are fastened.

The couple of the frames 411 and 412 are a front frame 411 and a rear frame 412. The front frame 411 defines a front surface of the door assembly 400 and is exposed outside. The rear frame 412 defines a rear surface of the door assembly 400 and faces the front surface of the body 10.

Together with that, each frame 411 and 412 is formed in a ring shape having an opening inside.

A circumference surface 413 bent inwardly along the circumference of front frame 411 is formed as one body with the front frame 413 to have predetermined space therein. The rear frame 412 has a plate shape to close the space formed in the front frame 411 by the circumference surface 413.

More specifically, the other end of the door hinge 510 recessed in the recess part 620 is fastened to a side of the frame part 412 and 413, and the hook assembly 520 is installed on the other side thereof. The hook assembly 520 is selectively locked to the locking assembly 530 mounted within the recess part 620 of the body 10.

The door hinge 510 and the hook assembly 520 are provided between the front frame 411 and the rear frame 412, which is the inside of the frame part.

Also, the door handle (not shown) is in communication with the hook assembly 520 to operate the hook assembly 520.

The door glass 430 is provided in an opened center portion of the frame part.

The door glass 430 is made of glass for a user to check the inside of the drum 30, with preventing the exposure of the laundry, of course.

Referring to FIGS. 5 to 8, the step part 630 will be described.

The step part 630 is stepped toward an opposite portion to the door assembly 400 from the inner surface of the recess part 620.

The step part 630 is stepped along the inner circumference of the recess part 620.

Commonly, there should be predetermined space between the recess part 620 and the door assembly 400 due to the door hinge 510 for securing the opening angle of the door assembly 400 as much as possible. Accordingly, in case the door assembly 400 should receive external impact, damage of the door assembly 400 might rise due to the space. Then, the step part 630 prevents the damage of the door assembly 400 in advance.

In this embodiment, the step part 630 is a step.

Alternatively, although not shown in drawings, the step part 630 may have more than two steps. If the step part 630 has multi-steps, the portion of the recess part 620 where the step part 630 is formed may be reinforced enough to prevent the problem of being curved or deformed.

Figure 7:
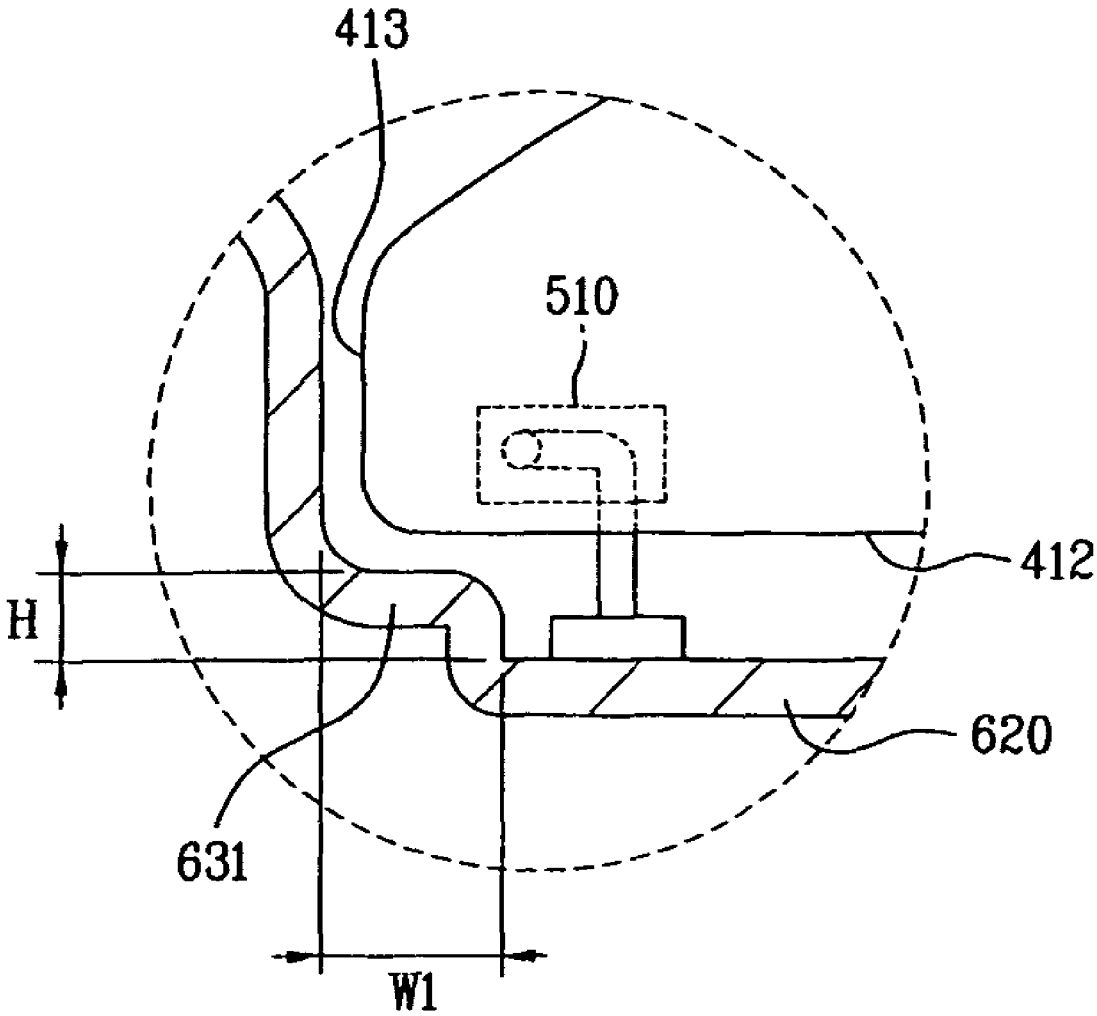
FIG. 7 is an enlarged view of "A" shown in FIG. 5.
Figure 8:
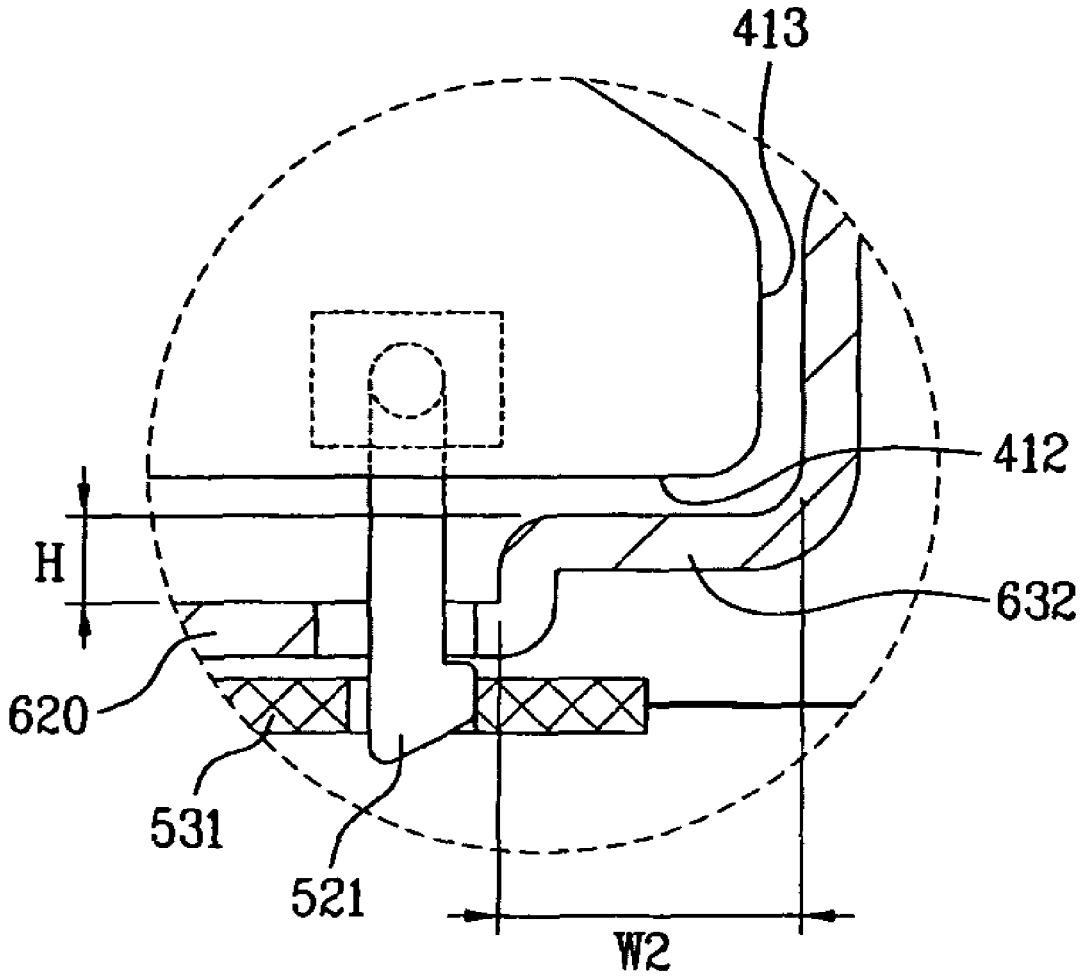
FIG. 8 is an enlarged view of "B" shown in FIG. 5.

As shown in FIGS. 7 and 8, this embodiment presents that the width (W1) of a facing part 631 facing the door hinge is different from the width (W2) of a facing part 632 facing the hook assembly 520. Here, the width is the distance projected inwardly from the inner circumference of the recess part 620.

Figure 6:
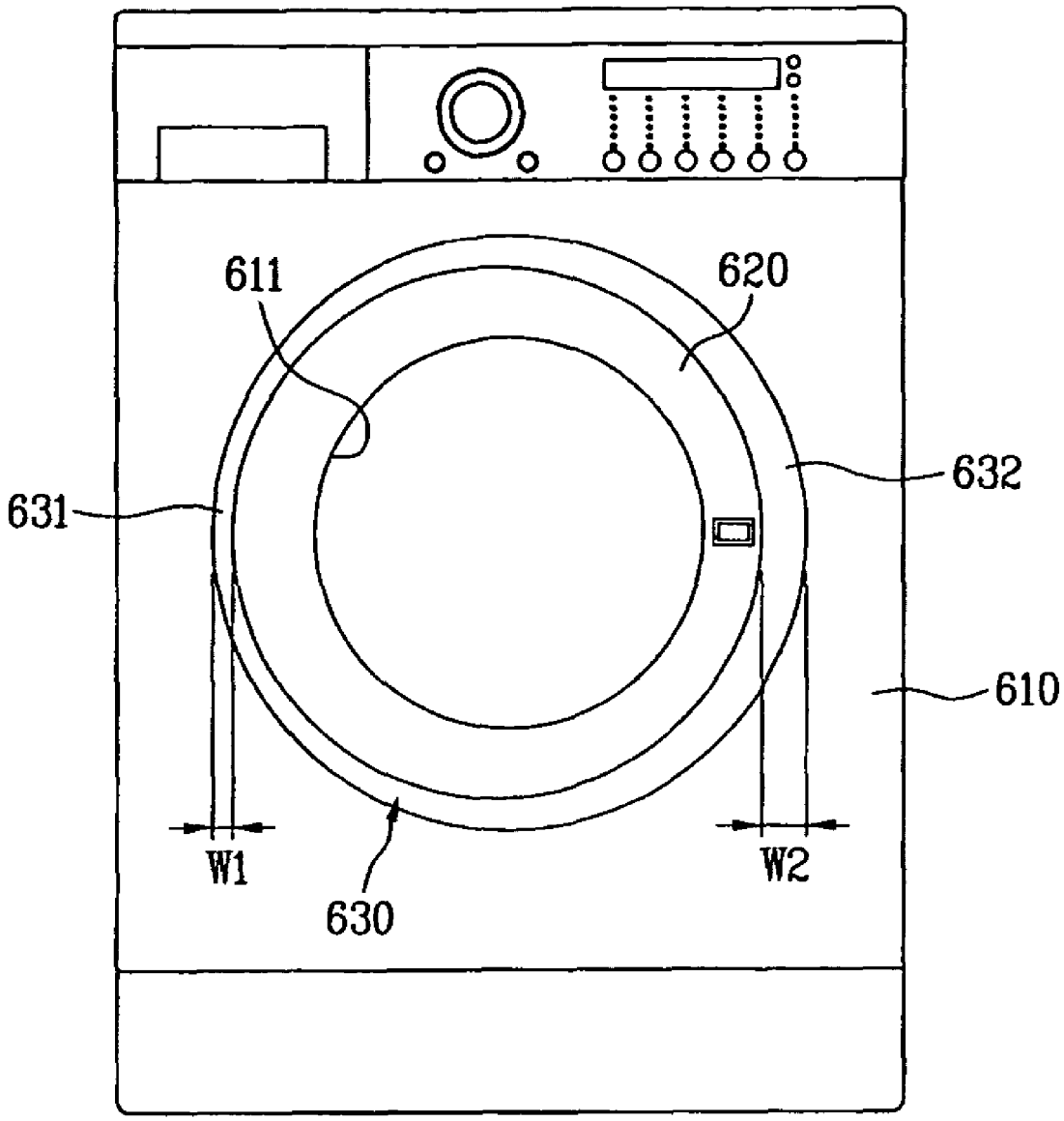
FIG. 6 is a diagram illustrating a cabinet cover having the door assembly removed, seen from a front, to describe the structure of a step part according to the embodiment of the present invention.

More specifically, as shown in FIG. 6, the facing part 631 of the step part 630 facing the door hinge is wider and wider as coming to the facing part 632 facing the hook assembly 520.

The facing part 631 of the step part 630 is facing the portion of the door assembly 400 where the door hinge is fastened, and the facing part 632 of the step part 630 is facing the portion of the door assembly 400 where the hook assembly 520 is provided.

Especially, the width (W1) of the facing part 631 facing the door hinge is as large as not receiving interference from the edge of the door assembly 400. That is, the larger the width (W1) is, the better. However, it is preferred that the width (W1) of the facing part 631 is formed not to interfere with the rotation of the door assembly 400. Thus, the opening angle of the door assembly 400 may be maximized.

The reason why the larger each width (W1) (W2) of the facing parts 631 and 632, the better is that the step part 630 can support the door assembly 400 securely if an external impact is applied to the closed door assembly 400.

Preferably, the width (W2) of the facing part 632 facing the hook assembly 520 is formed twice as large as the width (W1) of the facing part 631 facing the door hinge.

That is because the step part 630 can support the door assembly 400 as securely as possible not to create the cut caused by the door assembly 400's sliding from the step part 630 to collide with the cabinet cover 610, in spite of the external impact toward the inside of the recess part. If strong external impact is applied to the door assembly 400, the circumference of the door assembly 400 goes aside the step part 630 and is inserted in the inner surface of the recess part. Thus, when the width (W2) of the facing part 632 is twice as large as the width (W1) of the facing part 631, the problems may be prevented, for example the door assembly 400 may get the cut, the door hinge 510 may be deformed and the hook assembly 620 may be damaged.

The reason why the width (W1) of the facing part 631 may be formed relatively smaller than the width (W2) of the facing part 631 is that the portion of the door assembly 400, where the facing part 631 is provided, is in a state of being supportably inserted in the recess part 620 by the door hinge 510. Thus, even when the external impacts applied to the portion of the door assembly 400, the load generated by the impact is dispersed to the facing part 631 and the door hinge 510. Thereby, secure support may be maintained.

Meanwhile, in the embodiment of the present invention, it is preferred that the height (H) of the step part 630 is high enough to precisely communicate the hook assembly 520 with the locking assembly 530.

As shown in FIG. 8, the end of the hook 521 can precisely press a locking member 531 of the locking assembly 530, in case the door assembly 400 closes the opening 611 air-tight.

The locking member 531 is in communication with a switch (not shown) checking whether the door assembly 400 is opened. in case the door assembly 400 closes the opening air tight, the end of the hook 521 presses the locking member 531, and is engaged to the inner surface of the recess part, which is an inside of a locking hole, or to the locking member 531 to lock the door assembly 400.

Figure 1:
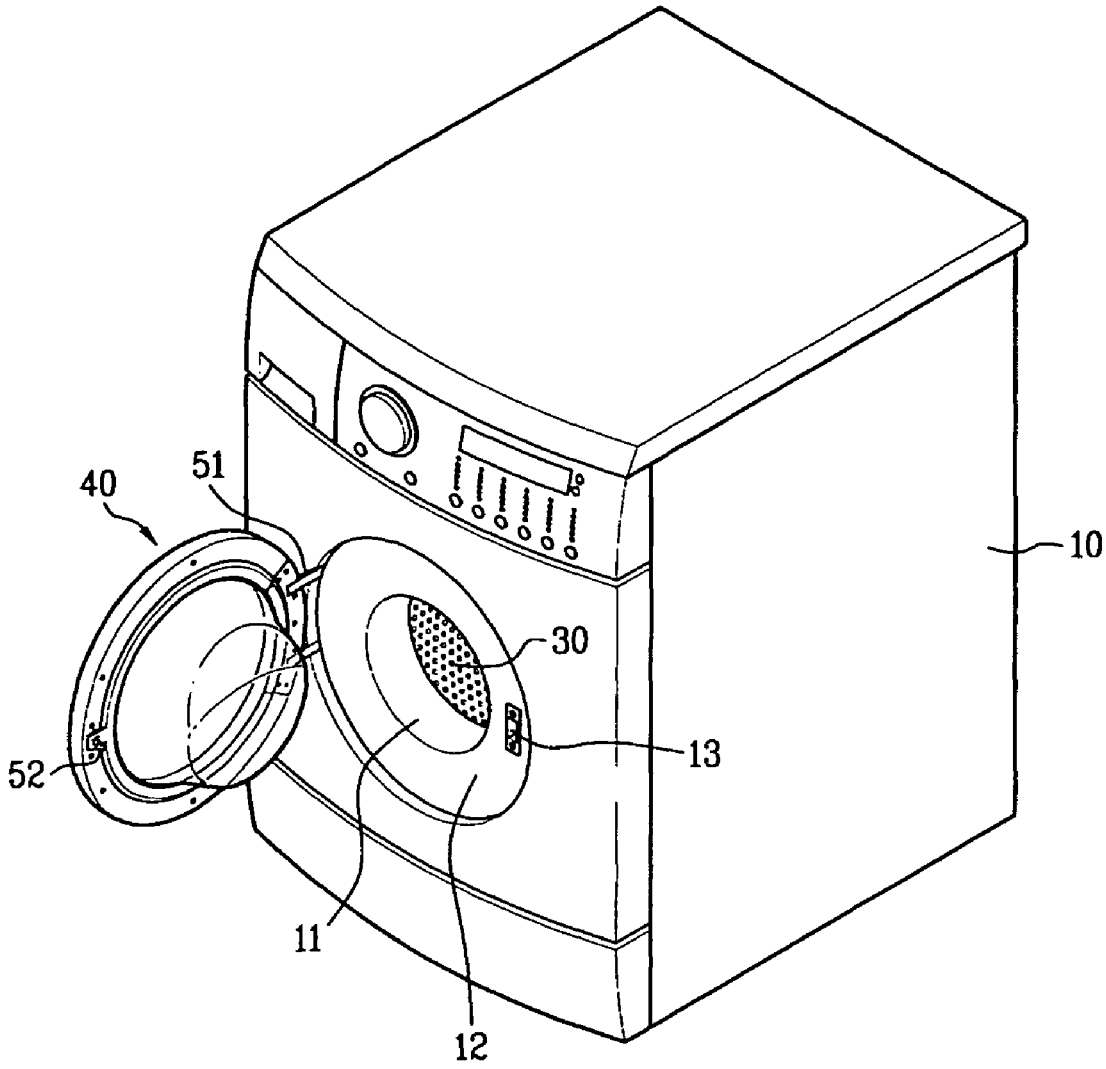
FIG. 1 is a perspective view illustrating an exterior of a conventional drum type laundry machine.
Figure 2:
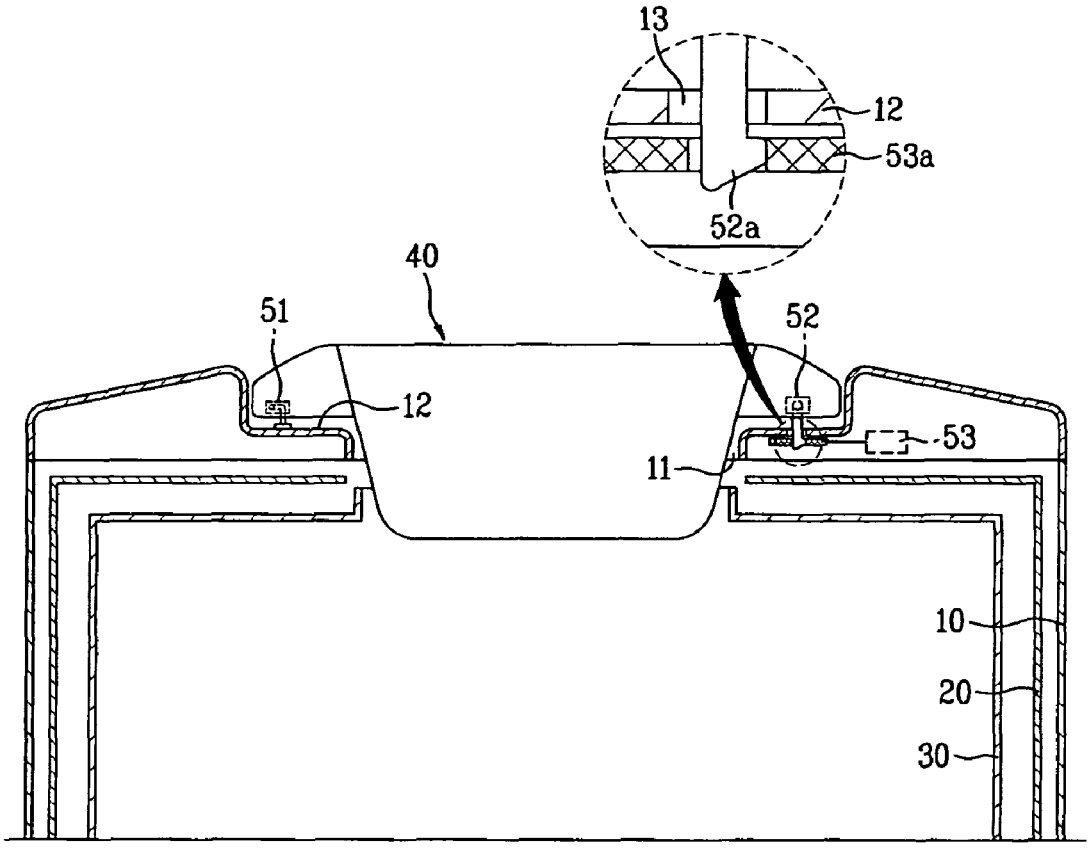
FIG. 2 is a sectional view schematically illustrating the fastening structure between a door assembly and a body of the conventional drum type laundry machine.
Figure 3:
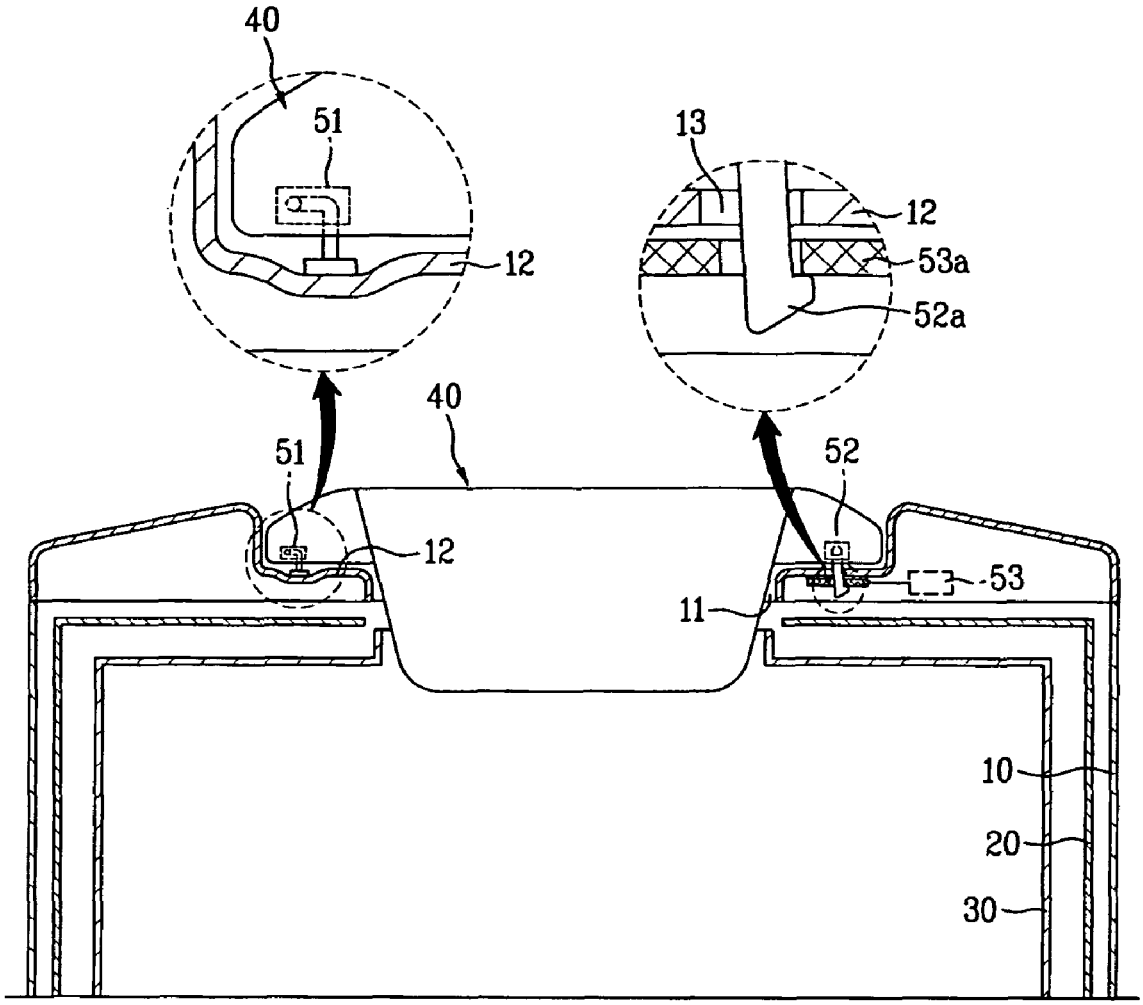
FIG. 3 is a sectional view schematically illustrating a state where the door assembly of FIG. 2 has received external impact.

If the door assembly 400 is inserted in the recess part 620 too much, the end of the hook 521 is beyond the portion where the locking member 531 is installed. Thereby, the end of the hook 521 fails to press the locking member 531 and the switch (not shown) fails to check whether the door assembly 400 is opened or closed. That has been described in the related art, referring to FIG. 3.

Figure 9:
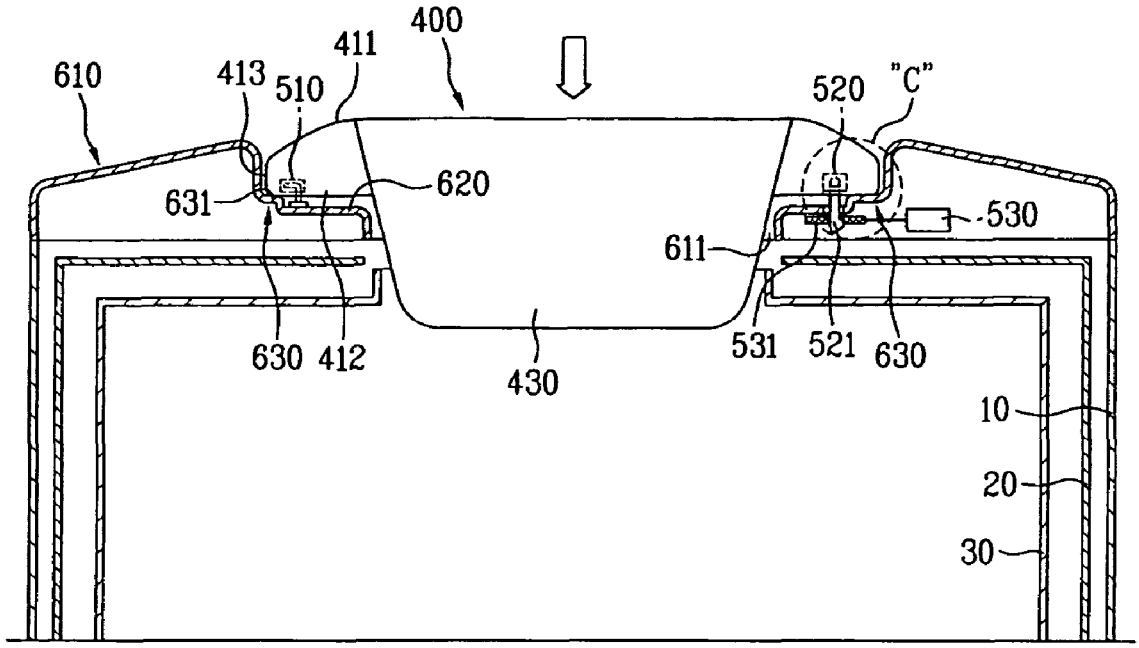
FIG. 9 is a sectional view schematically illustrating a state where the door assembly is contacted with a facing part of the step part.
Figure 10:
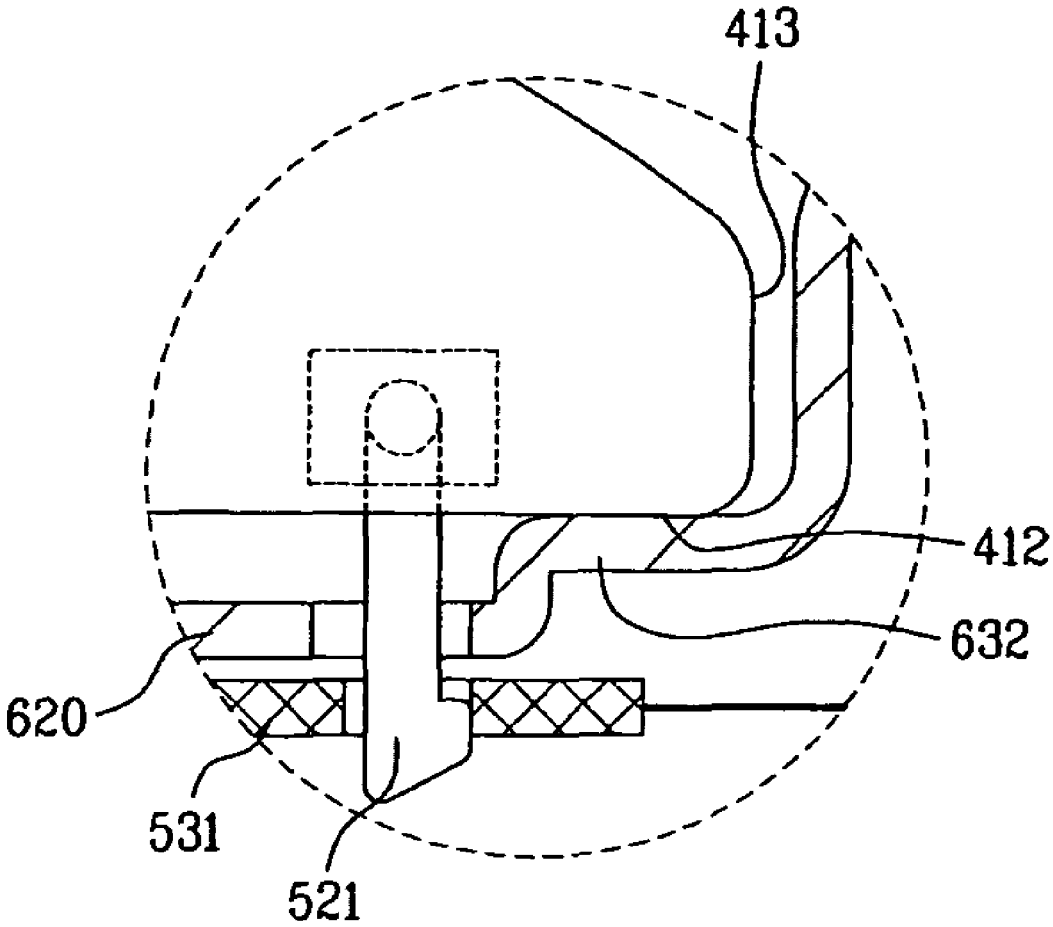
FIG. 10 is an enlarged view of "C" shown in FIG. 9.

Accordingly, the height (H) of the step part 630 is determined for the end of the hook 521 to press the locking member 531 even when the door assembly 400 is in close contact, as shown in FIGS. 9 and 10, so that the hook assembly 520 of the door assembly 400 may be in communication with the locking assembly 530.

Preferably, there is a predetermined distance between the step part 630 and the door assembly 400 not to be contacted, in a state of a normal maintenance.

Next, the state will be described in detail, where the door assembly 400 of this embodiment selectively opens/closes the opening 611 formed on the cabinet cover 610 of the body 10.

First of all, FIG. 4 illustrates that the opening 611 formed on the body 10 is opened from the door assembly 400.

In that case, the hook assembly 520 is unlocked from the locking assembly 530. Together with that, the door assembly 400 is forwardly rotated about the door hinge 510.

At that time, the corner of the door assembly 400, adjacent to the portion the door hinge 510 is fastened to, may not get interference from the facing part 631 facing the door hinge. That is because the width (W1) of the facing part 631 is relatively smaller than those of other portions.

Thus, the door assembly 400 can be opened more than 160° to prevent the user's inconveniences.

FIG. 5 illustrates that the opening 611 formed on the body 10 is closed by the door assembly 400.

In that case, the hook assembly 520 is locked to the locking assembly 530 provided in the recess part 620. Together with that, the door assembly 400 is inserted in the recess part 620.

At that time, as shown in FIGS. 7 and 8, the rear circumference of the door assembly 400 is supported by the step part 630.

Especially, the rear circumference of the door assembly 400's portion, where the hook assembly 520 is provided, is supported by the facing part 632 of the step part 630.

Here, the width (W2) of the facing part 632 facing the hook assembly is relatively larger than those of the other portions. The width (W2) of the facing part 632 is large enough to securely support the door assembly 400 even when severe external impact is applied to the door assembly 400. Thus, the deformation of the door assembly 400 or the door assembly 400's being curved will be prevented.

Furthermore, since the step part 630 is stepped from the recess part 620, the step part 630 may play a role of a reinforcing part for dispersing the load applied to the recess part 620 from the door assembly 400. Also, for that, the deformation of the recess part 620 or the recess part 620's being curved will be prevented.

Still further, the door assembly 400 supported by the step part 630 is positioned for the end of the hook 521 of the hook assembly 520 to precisely press the locking member 531 of the locking assembly 530, the controller (not shown) can recognize whether the door assembly 400 is opened.

Therefore, the embodiment of the present invention is a distinguishably useful invention, because of the structure of the step part 630, wherein the door assembly 400 can secure its maximum opening angle due to the structure of the step part 630 formed within the recess part 620 and the external impact applied to the door assembly 400 may be dispersed by the step part 630 and also it is precisely checked whether the door assembly 400 is opened or closed.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A drum type laundry machine comprising:

a cabinet cover for defining a front surface of the machine, the cabinet cover having an opening for loading/unloading laundry therein/there from;

a recess part recessed toward an inside of the machine along a circumference of the opening;

a door assembly spaced a predetermined distance from the recess part when the door assembly is closed over the opening; and a protrusion projected from the recess part to reinforce strength of the recess part and to support the door assembly securely when receiving external impact, wherein:

the protrusion includes a step part and a facing part, the step part is stepped from a surface of the recess part toward the door assembly in a direction that is substantially perpendicular to a surface of the recess part, the facing part contacts the door assembly when closed over the opening to prevent the door assembly from contacting the recess part, the opening is oriented relative to a central axis, the recess part is offset relative to the opening, and the facing part is offset relative to the recess part based on a difference between a first width and a second width different from the first width, the first width corresponding to a width of the facing part at a location proximate a latch of the door assembly and the second width corresponding to a width of the facing part proximate a hinge of the door assembly.

2. The drum type laundry machine of claim 1, wherein the protrusion is formed at a position with a predetermined width that does not interfere with the door assembly.

3. The drum type laundry machine of claim 1, wherein the facing part is formed along an inner perimeter of the recess part.

4. The drum type laundry machine of claim 1, wherein the step part has at least one step.

5. The drum type laundry machine of claim 1, wherein the facing part is coupled to the step part to face some portion of the door assembly's rear surface when the door assembly is closed.

6. The drum type laundry machine of claim 1, wherein the door hinge is fastened to a first side of a door, and a locking assembly is selectively locked to a hook assembly provided at a second opposing side of the door.

7. The drum type laundry machine of claim 6, wherein the facing part is formed along an inner perimeter of the recess part.

8. The drum type laundry machine of claim 6, wherein the step part has at least one step.

9. The drum type laundry machine of claim 7, wherein the width of the facing part facing the door hinge increases in a direction towards the facing part facing the hook assembly.

10. The drum type laundry machine of claim 1, wherein the first width of the facing part is substantially two or more times as large as the second width of the facing part.

11. The drum type laundry machine of claim 1, wherein the second width of the facing part facing the door hinge is formed so as not to interfere with the door assembly when the door assembly is opened/closed.

12. A drum type washing machine comprising:

a door assembly:

a cabinet cover for forming a front exterior surface and having a recessed portion which is for allowing at least partially the door assembly therein, the recessed portion having an opening for loading/unloading laundry, a first portion surrounding the opening and having a lock to lock the door assembly, and a second portion surrounding the first portion and protruded from the first portion toward the door assembly, wherein:

the second portion includes a step part and a facing part, the step part stepped from a surface of the first portion in a direction substantially perpendicular to a surface of the first portion, the facing part contacts the door assembly when closed over the opening to prevent the door assembly from contacting the recessed portion, the opening is oriented relative to a central axis, the first portion is offset relative to the opening, and the facing part is offset relative to the first portion based on a difference between a first width and a second width different from the first width, the first width corresponding to a width of the facing part at a location proximate a latch of the door assembly and the second width corresponding to a width of the facing part proximate a hinge of the door assembly.

13. The drum type washing machine as claimed in claim 12, wherein the first width is greater than the second width.

14. A laundry machine comprising:

a housing;

a drum within the housing; and a door which opens and closes relative to an opening that leads into the drum, wherein:

the door at least partially covers a circumferential portion of the housing formed around the opening, the circumferential portion has a first surface and a second surface, the first surface is closer to the opening than the second surface, the second surface is on a different plane from the first surface and is closer to the door than the first surface, the first and second surfaces are substantially parallel to the door, a first width of the second surface adjacent a hinge of the door is less than a second width of the second surface adjacent a side of the door opposing the hinge, the opening is oriented relative to a central axis, the first surface is offset relative to the opening, and the second surface is offset relative to the first surface based on a difference between a first and second widths.

15. The laundry machine of claim 14, wherein the second surface has a continually varying width around the opening.

* * * * *